United States Patent [19]

Zehr

[11] 4,182,384

[45] Jan. 8, 1980

[54] FIRE EXTINGUISHER DISCHARGE STATION

[75] Inventor: William J. Zehr, Des Plaines, Ill.

[73] Assignee: The Protectoseal Company, Bensenville, Ill.

[21] Appl. No.: 921,724

[22] Filed: Jul. 3, 1978

[51] Int. Cl.[2] ..... B65B 31/00

[52] U.S. Cl. ..... 141/7; 141/59; 141/363; 141/375

[58] Field of Search ..... 141/7, 8, 59, 65, 83, 141/231, 286, 375, 113, 319, 320, 321, 322, 363; 137/205

[56] References Cited

U.S. PATENT DOCUMENTS

| | | | |
|---|---|---|---|
| 2,815,621 | 12/1957 | Carter | 141/59 X |
| 4,053,001 | 10/1977 | Healey | 141/83 X |

*Primary Examiner*—Richard E. Aegerter
*Assistant Examiner*—Frederick R. Schmidt
*Attorney, Agent, or Firm*—Rummler & Snow

[57] ABSTRACT

A method and means for removing the fire extinguisher dry powder from its pressurized cylinder using a vacuum pump and appropriate apparatus and collecting the powder in a drum and to prevent powder degradation. The apparatus is simple to operate and provides a clean, fast method for discharging and removing dry chemical powder from fire extinguisher cylinders.

4 Claims, 4 Drawing Figures

FIRE EXTINGUISHER DISCHARGE STATION

BACKGROUND OF THE INVENTION

By fire protection regulations, the dry powder in a pressurized fire extinguisher cylinder must be removed and replaced periodically to insure the powder will be effective if needed to put out a fire. This dry chemical powder is extremely fine and the mere disposition of the powder is a total waste and is expensive. Further, the powder being so fine will readily admix with the air when agitated and pollute the atmosphere during normal transfer from or to a drum to or from a fire extinguishing cylinder. It was to overcome these objections that the present invention was conceived.

SUMMARY OF THE INVENTION

A method and means for depressurizing and removing dry chemical powder from a pressurized fire extinguishing cylinder by use of a cradle on a cover of a drum to support the cylinder in inverted position while depressurizing the same and a small amount of powder and directing it into the drum, then placing the cylinder in upright position; providing a conduit connection between the interior of the drum and the cylinder; then creating a vacuum in the drum to remove the powder from the cylinder and into the drum, all without polluting the air.

DETAILED DESCRIPTION OF THE DRAWINGS

Figure 1:
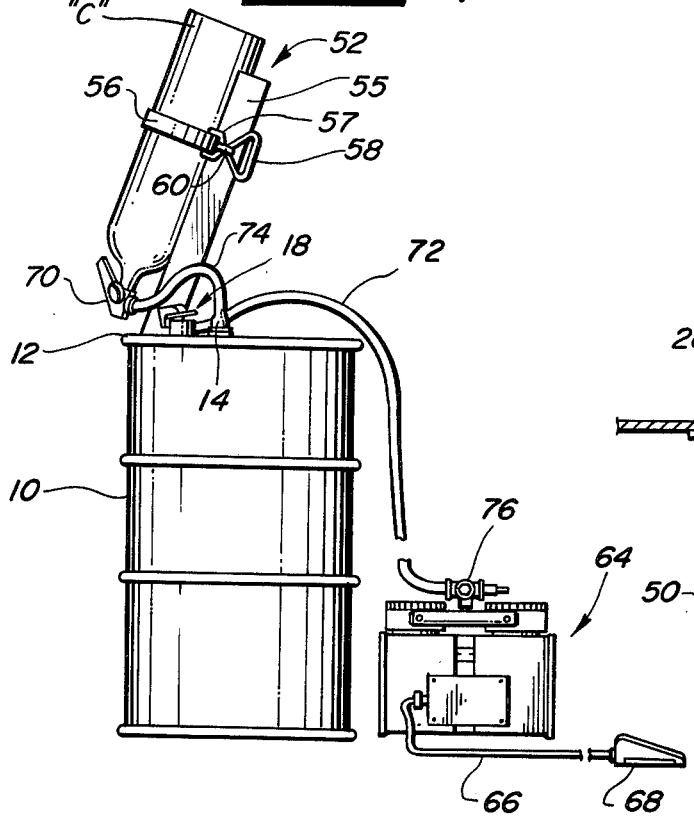
FIG. 1 is a side elevational view of a portion of my new invention.

The drum 10 is provided with a removable cover 12. The cover 12 is anchored tightly to the rim of the drum when the method and apparatus of the present invention are in operation.

Anchored to the cover 12 is a fitting 14 carrying a vertically-extending short inlet tube 16 anchored therein and extending above and below the fitting 14.

A relief valve 18 comprises a hollow housing 20, the lower end of which extends below the cover 12 and is secured thereto by any suitable means. The housing is provided with a pivotal cover 22 having a vertically-disposed rod 24 secured at one end medially thereto. The other end is pivotally anchored to an arm 26 having its other end bent downwardly at right angles with its distal end pivotally anchored to a stub 28 extending from the housing 20 whereby the cover 22 is pivotally movable upwardly. A suitable gasket 30 is secured to the under side of the cover 22 to seal the upper opening of the housing 20. A short, metal, hollow, horizontally-disposed tube 32 extends outwardly from and is secured to the housing 20. This is the vacuum conduit fitting which will be described later.

Figure 3:
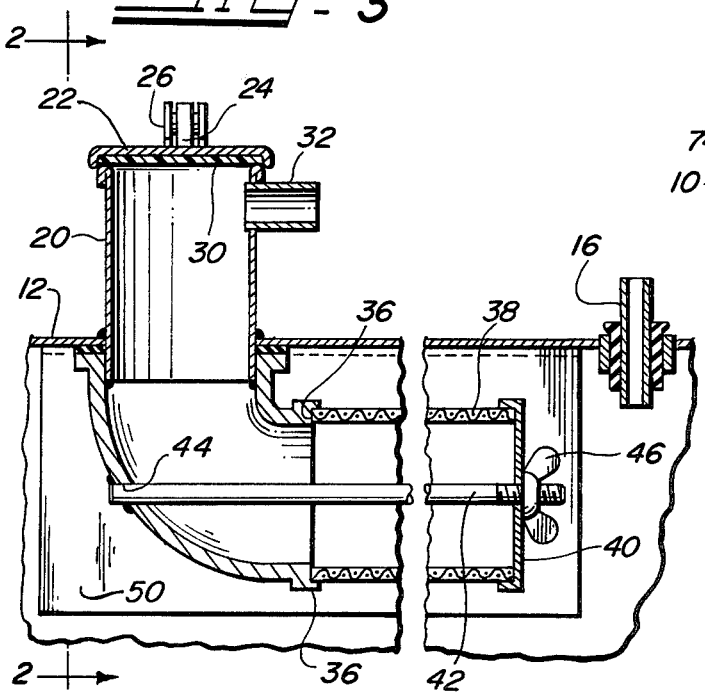
FIG. 3 is a cross-sectional view taken on the line 3—3 of FIG. 2.
Figure 4:
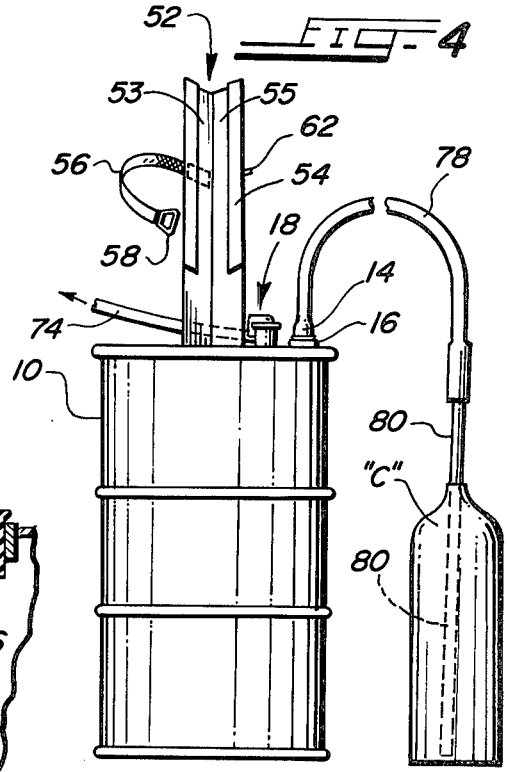
FIG. 4 is an elevational view with parts broken away.

An L-shaped hollow member or elbow 34 is anchored to the lower end of the housing 20 in any suitable manner whereby the lower end of the housing 20 extends in the upper end of the elbow 34, as clearly shown in FIG. 3, and is provided with an annular step

36 to seat one end of an elongated cylindrical filter 38. A cap 40 closes the other end of the filter. A tie rod 42 extends axially through the interior of the filter. One end of the tie rod 42 is inserted through an aperture 44 in the member 34 and anchored thereto in any suitable manner, such as by welding. The other end extends axially through the cap 40 and is positioned thereon by the wingnut 46.

Thus the interior of the housing 20 has direct communication with the interior of the filter.

Figure 2:
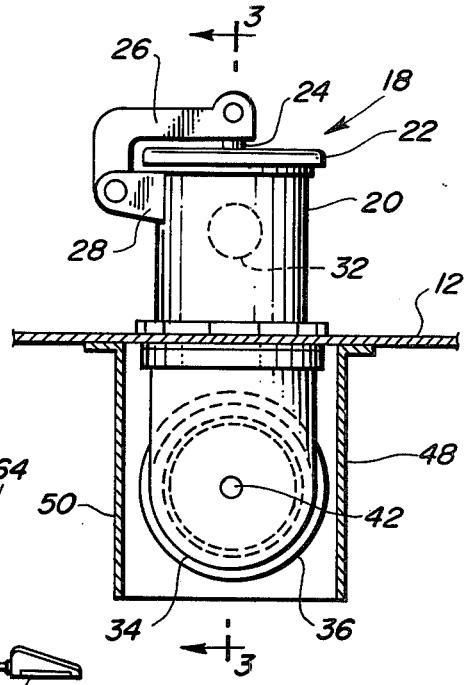
FIG. 2 is a cross-sectional view taken on the line 2—2 of FIG. 3 with the relief valve and L-fitting shown in full lines.

A pair of spaced baffle plates 48, 50 extend downwardly from the cover 12 and one on each side of the filter 38. As shown in FIG. 2, the upper ends of each baffle plate are bent at right angles and welded to the cover plate 12.

A cradle 52 comprises a plate bent angularly upwardly medially of its side edges forming a pair of side walls 53, 55 each having a rubber strip friction cushion 54 at the free edges thereof extending substantially lengthwise. The cradle is anchored at its lower end to the cover 12 by any suitable means, such as welding. The cradle extends upwardly and angularly from the cover 12, as shown in FIG. 1, and extends partially over the cover 12. An elastic band 56 is anchored at one end by plate 57 to the side wall 55 and at the other end to a triangular-shaped handle 58 having an eye 60 secured to the upper end thereof. A short hook 62 is welded or otherwise secured to the side wall 53 in opposed relation to the plate 57, whereby when a pressurized fire extinguishing cylinder "C" with the chemical powder therein is placed on the cradle 52 in inverted position and the elastic band 56 is pulled over the cylinder with the eye 60 placed on the hook 62, the cylinder will thus be held thereon. (See FIG. 1.)

A vacuum pump 64 is positioned on the floor adjacent the drum 10 and has a conduit 74 extending therefrom and connected to the horizontally disposed tube 32 of the relief valve 18. The pump 64 is connected to a source of electric current (not shown) with the foot switch 68 positioned in the line to energize the pump.

The cylinder "C" is provided with the usual valve 70.

In operation, the cylinder "C" is placed on the cradle 52, as shown in FIG. 1. A short conduit 72 is connected to the valve 70 and the other end to the vertical tube 16. It is to be noted, as shown in FIG. 3, that the tube 16 is spaced away from the right hand end of both the filter 38 and the baffles 48, 50.

The valve 70 is gently opened to depressurize the cylinder 57. Only a small amount of fire extinguishing powder will be removed from the cylinder during this operation and will flow into the drum 10 because valve 70 has the usual siphon tube extending to the bottom of the cylinder. When pressure and powder is injected into the drum 10, the gas vents through the filter tube 38 and exhausts through the relief valve 18 leaving the powder on the filter and in the drum.

The cylinder "C" is then removed from its cradle 52 and placed on the floor adjacent the drum after the conduit 72 is removed therefrom and from the tube 16. The valve 70 is removed when the cylinder is vertically positioned on the floor.

A flexible conduit 74 is connected at one end to the valve 76 of the vacuum pump 64 and the other end is connected to the horizontal tube 32.

A long flexible conduit 78 is connected at one end to the vertical tube 16 and the other end to a pipe 80. The pipe 80 is inserted in the interior of the now depressurized cylinder "C", as shown in FIG. 2.

With the vacuum pump energized by stepping on the switch 68, a vacuum is pulled in the drum through the relief valve housing 20 and to the interior of the filter 38. When enough vacuum is built up in the drum 10, the powder in the cylinder "C" will be drawn up through the pipe 80, conduit 78, through the vertical tube 16, and into the drum 10. It is to be noted that the lower end of the pipe 80 lies adjacent the bottom of the cylinder. Hence substantially if not all the powder will be removed from the cylinder "C", and be normally ready for reuse.

The same operation will be repeated when a new cylinder requires the powder to be removed.

To clean the filter, while the vacuum pump is still operating, the operator merely removes the rod 80 and places a finger on the open end. Then, when a high vacuum has developed in the drum, he manually opens the cover 22 of the relief valve 18 and the inrush of air will be drawn into the valve housing, filter and drum, thereby causing any powder clinging to the filter exterior to be removed therefrom. It is to be observed that the powder passes directly to the drum, and hence does not escape into the air to pollute the same.

Although but one specific embodiment of this invention is herein shown and described, it will be understood that details of the construction shown may be altered or omitted without departing from the spirit of the invention as defined by the following claims.

I claim:

1. A pressurized fire extinguisher discharge station comprising:

(a) a drum;

(b) a cover for said drum;

(c) an inlet in said cover positioned adjacent the periphery of said cover and open to the interior of said drum;

(d) a cradle anchored at one end to said cover and extending angularly upwardly from said cover to support a fire extinguisher cylinder in inverted position and means for releasably retaining said pressurized cylinder on said cradle in inverse position for depressurizing said cylinder;

(e) a hollow relief valve having a housing connected to said cover and having communication to the interior of said drum;

(f) a tube in said valve connected to the interior of said drum;

(g) a vacuum pump, means connecting said pump and said drum through said tube for creating a vacuum in said drum;

(h) a horizontally disposed, hollow, cylindrical filter disposed in the upper end of said drum and secured to and depending from said cover and having fluid connection to said valve through which the ambient air in the drum must flow in creating a vacuum in said drum; and (i) flexible conduit means connected between said cover inlet and a depressurized cylinder having dry powder therein;

whereby when said pump is energized, a vacuum will be created in said drum and withdraw the powder from the cylinder into the interior of said drum.

2. A pressurized fire extinguisher discharge station according to claim 1 wherein said inlet is a vertically disposed tube secured to said cover, extending upwardly therefrom and open to the interior of said drum, and said valve is provided with a short tube anchored to and extending horizontally outwardly from said valve and open to the interior thereof and said cradle is provided with friction pads thereon and an elastic band to anchor the pressurized fire extinguisher cylinder to said cradle.

3. A pressurized fire extinguisher discharge station comprising:

(a) a drum;

(b) a cover for said drum;

(c) a vertically disposed inlet tube secured to said cover, extending upwardly therefrom, positioned adjacent the periphery of said cover and open to the interior of said drum;

(d) a relief valve having a housing anchored at one end to said cover adjacent the periphery of the cover and generally opposite said vertical tube, said valve open to said drum, a short tube anchored to and extending horizontally from said housing and open to the interior thereof;

(e) a cradle anchored at one end to said cover adjacent said relief valve and extending angularly upwardly from said cover to support a filled fire extinguisher cylinder and having friction pads thereon and an elastic band to anchor the pressurized fire extinguisher cylinder to said cradle;

(f) a vacuum pump with a flexible conduit connecting said pump and said short tube;

(g) a horizontally disposed, hollow, cylindrical filter disposed in the upper end of said drum and secured to and depending from said cover, one end of said filter directly connected to said housing of said relief valve and opened thereto; and (h) flexible conduit means connected between said vertically disposed tube and a depressurized cylinder having dry powder therein; whereby when said pump is energized, a vacuum will be created in said drum and withdraw the powder from the cylinder into the interior of said drum.

4. The method of discharging a powdered chemical from a pressurized fire extinguishing cylinder which is first inverted for depressurizing the same and the pressure therein is released from said cylinder into an airtight covered drum, then the cylinder is removed and placed upright on the floor, then the drum is placed under a vacuum, then a conduit connection is made between the cylinder and the interior of the drum and an elongated tube is secured to the conduit for insertion in the bottom of the cylinder, whereby the chemical powder will be withdrawn from the bottom of the cylinder and the powder in the cylinder is collected in the drum.

* * * * *